US009267373B2

(12) United States Patent
Kammerer et al.

(10) Patent No.: US 9,267,373 B2
(45) Date of Patent: Feb. 23, 2016

(54) CHISEL HOLDER AND LOWER TOOL PART FOR A CHISEL HOLDER

(75) Inventors: Karl Kammerer, Fluorn-Winzeln (DE); Markus Roth, Aichhalden (DE); Bernhard Diessner, Telfes in Stubai (AT); Thomas Lehnert, Oberraden (DE); Karsten Buhr, Willroth (DE); Martin Lenz, Grossmaischeid (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 68 days.

(21) Appl. No.: 13/989,837

(22) PCT Filed: Dec. 2, 2011

(86) PCT No.: PCT/EP2011/071585

§ 371 (c)(1),
(2), (4) Date: Aug. 8, 2013

(87) PCT Pub. No.: WO2012/072783

PCT Pub. Date: Jun. 7, 2012

(65) Prior Publication Data

US 2013/0307318 A1 Nov. 21, 2013

(30) Foreign Application Priority Data

Dec. 3, 2010 (DE) ..... 10 2010 061 019

(51) Int. Cl.
*E21C 35/18* (2006.01)
*E21C 35/19* (2006.01)
*E21C 35/193* (2006.01)

(52) U.S. Cl.
CPC ..... *E21C 35/19* (2013.01); *E21C 35/18* (2013.01); *E21C 35/193* (2013.01); *E21C 35/1933* (2013.01); *E21C 2035/191* (2013.01)

(58) Field of Classification Search
CPC ... E21C 35/18; E21C 35/19; E21C 2035/191; E21C 35/193; E21C 35/1933; E21C 35/1936; E21C 35/197
See application file for complete search history.

(56) References Cited

U.S. PATENT DOCUMENTS 2,452,081 A 10/1948 Sullinger
3,143,177 A 8/1964 Galorneau et al.
(Continued)

FOREIGN PATENT DOCUMENTS

CA 2742849 A1 5/2010
CN 1942655 A 4/2007
(Continued)

OTHER PUBLICATIONS

U.S. Appl. No. 13/822,895, filed Mar. 13, 2013 to Lehnert et al.
(Continued)

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

The invention relates to a bit holder having an insertion projection and having a bore-shaped bit receptacle that has a longitudinal center axis, a convexly curved support surface being provided on a base part. A bit holder of this kind can be implemented in compact and stable fashion in particular by the fact that the longitudinal center axis of the bit receptacle intersects the support surface.

24 Claims, 8 Drawing Sheets

(56) References Cited

U.S. PATENT DOCUMENTS

| | | | | |
|---|---|---|---|---|
| 3,498,677 | A | 3/1970 | Morrow | |
| 3,992,061 | A | 11/1976 | Rollins | |
| 4,240,669 | A | 12/1980 | Rollins | |
| 4,275,929 | A | 6/1981 | Krekeler | |
| 4,302,055 | A | 11/1981 | Persson | |
| 4,415,208 | A | 11/1983 | Goyarts | |
| 4,542,943 | A | 9/1985 | Montgomery, Jr. | |
| 4,650,256 | A | 3/1987 | Wetzinger | |
| 4,693,518 | A | 9/1987 | Sulosky et al. | |
| 4,709,614 | A * | 12/1987 | Klumpp | 89/1.35 |
| 4,828,327 | A | 5/1989 | Wechner | |
| 4,915,455 | A | 4/1990 | O'Neill et al. | |
| 5,011,229 | A | 4/1991 | O'Neill et al. | |
| 5,070,609 | A * | 12/1991 | Teramachi | 29/898.049 |
| 5,186,575 | A | 2/1993 | Wirtgen | |
| 5,322,351 | A | 6/1994 | Lent | |
| 5,378,050 | A | 1/1995 | Kammerer et al. | |
| 5,529,384 | A | 6/1996 | Ojanen et al. | |
| 5,573,308 | A | 11/1996 | Simons et al. | |
| 5,683,144 | A | 11/1997 | Kammerer et al. | |
| 6,234,579 | B1 | 5/2001 | Montgomery, Jr. | |
| 6,244,665 | B1 | 6/2001 | Bise et al. | |
| 6,619,756 | B1 | 9/2003 | Holl et al. | |
| 6,619,757 | B1 | 9/2003 | Kammerer | |
| 6,644,755 | B1 | 11/2003 | Kammerer | |
| 6,685,273 | B1 | 2/2004 | Sollami | |
| 6,712,431 | B1 * | 3/2004 | Bosch et al. | 299/104 |
| 6,764,140 | B2 | 7/2004 | Carson, Jr. et al. | |
| 6,779,850 | B1 | 8/2004 | Schibeci et al. | |
| 6,854,810 | B2 | 2/2005 | Montgomery, Jr. | |
| 6,866,343 | B2 | 3/2005 | Holl et al. | |
| 7,086,704 | B2 | 8/2006 | Holl et al. | |
| 7,300,115 | B2 | 11/2007 | Holl et al. | |
| D567,270 | S | 4/2008 | Chiang | |
| D574,689 | S | 8/2008 | Holl et al. | |
| D575,610 | S | 8/2008 | Holl et al. | |
| 7,461,903 | B2 | 12/2008 | Tewes et al. | |
| D585,259 | S | 1/2009 | Holl et al. | |
| 7,475,949 | B2 | 1/2009 | Helsel et al. | |
| 7,537,288 | B2 | 5/2009 | Chiang | |
| 7,547,075 | B2 | 6/2009 | Tewes et al. | |
| 7,597,402 | B2 | 10/2009 | Tewes et al. | |
| 7,744,164 | B2 * | 6/2010 | Hall et al. | 299/104 |
| 7,784,875 | B2 | 8/2010 | Holl et al. | |
| 7,922,256 | B2 | 4/2011 | Kammerer et al. | |
| 7,922,257 | B2 | 4/2011 | Kammerer | |
| D638,453 | S | 5/2011 | Buhr et al. | |
| 8,061,783 | B2 | 11/2011 | Keller et al. | |
| D657,648 | S | 4/2012 | Wachsmann | |
| D666,226 | S | 8/2012 | Buhr et al. | |
| D666,641 | S | 9/2012 | Buhr et al. | |
| D666,642 | S | 9/2012 | Buhr et al. | |
| D666,643 | S | 9/2012 | Buhr et al. | |
| D667,854 | S | 9/2012 | Kammerer et al. | |
| D667,855 | S | 9/2012 | Kammerer et al. | |
| D667,856 | S | 9/2012 | Kammerer et al. | |
| D671,578 | S | 11/2012 | Buhr et al. | |
| 8,622,484 | B2 | 1/2014 | Charlton | |
| 8,746,807 | B2 | 6/2014 | Lehnert et al. | |
| 2002/0074850 | A1 | 6/2002 | Montgomery, Jr. | |
| 2003/0146355 | A1 * | 8/2003 | Burr | 248/188.4 |
| 2004/0051370 | A1 | 3/2004 | Montgomery, Jr. | |
| 2006/0119165 | A1 | 6/2006 | Holl et al. | |
| 2008/0093912 | A1 | 4/2008 | Willoughby | |
| 2009/0085396 | A1 | 4/2009 | Chiang | |
| 2009/0160238 | A1 | 6/2009 | Hall et al. | |
| 2009/0289493 | A1 * | 11/2009 | Holl et al. | 299/102 |
| 2009/0293249 | A1 | 12/2009 | Lehnert et al. | |
| 2010/0045094 | A1 | 2/2010 | Sollami | |
| 2010/0076697 | A1 | 3/2010 | Wagner et al. | |
| 2011/0006588 | A1 | 1/2011 | Monyak et al. | |
| 2011/0148178 | A1 | 6/2011 | Lehnert et al. | |
| 2011/0148179 | A1 | 6/2011 | Lehnert et al. | |
| 2011/0266860 | A1 | 11/2011 | Charlton | |
| 2013/0241264 | A1 | 9/2013 | Lehnert et al. | |
| 2013/0241265 | A1 | 9/2013 | Lehnert et al. | |

FOREIGN PATENT DOCUMENTS

| | | | |
|---|---|---|---|
| CN | 101018927 | A | 8/2007 |
| CN | 101091037 | A | 12/2007 |
| CN | 101175895 | A | 5/2008 |
| CN | 202595605 | U | 12/2012 |
| CN | 202788849 | U | 3/2013 |
| DE | 2940288 | A1 | 5/1980 |
| DE | 3411602 | A1 | 10/1985 |
| DE | 4322401 | A1 | 1/1995 |
| DE | 29822369 | U1 | 3/1999 |
| DE | 19908656 | C1 | 8/2000 |
| DE | 10161009 | A1 | 11/2002 |
| DE | 202005001311 | U1 | 3/2005 |
| DE | 102005010678 | A1 | 9/2006 |
| DE | 102005017760 | A1 | 10/2006 |
| DE | 102005055544 | A1 | 5/2007 |
| DE | 202007013350 | U1 | 2/2008 |
| DE | 202007013350 | U1 | 3/2008 |
| DE | 102004030691 | B4 | 12/2008 |
| DE | 10261646 | B4 | 2/2010 |
| DE | 202009014077 | U1 | 4/2010 |
| DE | 102009059189 | A1 | 6/2011 |
| EM | 001848938 | | 4/2011 |
| EP | 0706606 | B1 | 3/1997 |
| EP | 0771911 | A1 | 5/1997 |
| EP | 0997610 | A1 | 5/2000 |
| JP | 4527043 | | 10/1970 |
| JP | 2008503669 | A | 2/2008 |
| KR | 1020050091022 | B1 | 9/2005 |
| TW | 407538 | U | 10/2000 |
| TW | I265836 | B | 11/2006 |
| TW | M326448 | U | 2/2008 |
| TW | M364551 | U1 | 9/2009 |
| TW | M378059 | U | 4/2010 |
| WO | 2006056269 | A1 | 6/2006 |
| WO | 2006119536 | A1 | 11/2006 |
| WO | 2010051593 | A1 | 5/2010 |
| WO | 2011004030 | A2 | 1/2011 |

OTHER PUBLICATIONS

U.S. Appl. No. 13/822,917, filed Mar. 13, 2013 to Lehnert et al.
U.S. Appl. No. 13/822,720, filed Mar. 13, 2013 to Lehnert et al.
U.S. Appl. No. 29/452,133, filed Apr. 12, 2013 to Buhr et al.
U.S. Appl. No. 29/452,136, filed Apr. 12, 2013 to Buhr et al.
U.S. Appl. No. 29/452,137, filed Apr. 12, 2013 to Buhr et al.
U.S. Appl. No. 29/452,139, filed Apr. 12, 2013 to Buhr et al.
DE 102010061019.4 "Examination Report" Oct. 20, 2011, 4 pp.
EP 11172525.5 "European Search Report" Dec. 8, 2011, 5 pp.
EP 11172527.1 "European Search Report" Dec. 8, 2011, 5 pp.
Co-pending U.S. Patent Application Publication No. US 2013/0241264 A1 published Sep. 19, 2013 to Lehnert et al.
Co-pending U.S. Patent Application Publication No. US 2013/0241265 Al published Sep. 19, 2013 to Lehnert et al.
English translation of Notification for the Opinion of Examination with translation of the search report, Taiwanese Application No. 100144345, mailing date Dec. 6, 2013, 4 pp.
First Examination Report with English translation, Chinese Patent Application No. 201110395057.2, Applicant: Wirtgen GmbH, Mailing Date: Jan. 30, 2014, 11 pp.
First Examination Report with English translation, Chinese Patent Application No. 201110394632.7, Applicant: Wirtgen GmbH, Mailing Date: Jan. 28, 2014, 19 pp.
Office Action of Dec. 16, 2014 in co-pending U.S. Appl. No. 13/991,297.
English translation of Notification for the Opinion of Examination issued for Taiwanese Application No. 100144345, mailed on Aug. 18, 2014, 3 pages.
Written Opinion issued for Singapore parallel patent application 2013041637 mailed on Jun. 27, 2014, 13 pages.

(56) References Cited

OTHER PUBLICATIONS

Written Opinion and Search Report issued for Singapore application No. 2013042320, dated on Jun. 5, 2014, 19 pages.
First Office Action dated Jan. 28, 2014, in related Chinese patent application No. 201110394632.7, with English translation, 19 pages.
English Translation of Notification for the opinion of Examination and search report from Taiwanese Patent Office mailed May 9, 2014, for related Taiwanese application No. 100144342, 6 pages.
Notification of the First Office Action with English translation, Chinese Patent Application No. 201110395057.2, Applicant: Wirtgen Gmbh, Mailing Date: Jan. 30, 2014, 11 pages.

* cited by examiner

CHISEL HOLDER AND LOWER TOOL PART FOR A CHISEL HOLDER

The invention relates to a bit holder having an insertion projection and having a bore-shaped bit receptacle that has a longitudinal center axis, a convexly curved support surface being provided on a base part.

The invention further relates to a tool bottom part for reception of a bit holder.

DE 298 22 369 U1 discloses a tool combination made up of a tool bottom part and bit holder. Such tools are usually used on road milling machines, recyclers, earth stabilizers, etc. The tool bottom part is welded onto the circumferential surface of a tubular cutting drum. A plurality of tool bottom parts are associated with one another on the cutting drum surface in such a way that protruding cutting helices and transport helices are produced. The bit holders can be inserted replaceably into insertion receptacles of the tool bottom parts. The bit holders themselves receive, again replaceably, at least one bit, usually a round shank bit. During tool utilization, forces that are in some cases considerable are received by the bit and are transferred via the bit holder into the tool bottom part. Good bracing of the bit holder with respect to the tool bottom part is therefore of particular importance for a long service life of the tool system.

DE 298 22 369 U1 proposes a frustoconical connection between the tool bottom part and the bit holder. A base part of the tool bottom part has for this purpose a frustoconical projection that is inserted into a conical receptacle of the tool bottom part. A holding part is welded onto the base part, facing away from the frustoconical projection. This holding part is penetrated by a cylindrical bore into which the shank bit can be inserted with its shank. Under heavy tool loads, it can happen that while the conical connection reliably transfers the forces, the welded-on projection can nevertheless break away.

It is an object of the invention to make available a bit holder and a tool bottom part with which large tool loads can dependably be dissipated with a compact design.

The object relating to the bit holder is achieved in that the longitudinal center axis of the bit receptacle intersects the support surface. During tool utilization, the forces received via the bit are thus dissipated directly into the support surface. This makes possible a stable design that reliably withstands even large loads. A compact design is also achieved with this feature, so that the bit can be guided relatively close to the surface of the tubular milling drum. The torques that are acting can thereby be reduced.

According to a variant embodiment of the invention, provision can be made that the support surface has a spherical surface contour. By way of this spherical surface contour, a ball joint can be constituted between the bit holder and the tool bottom part. The cutting force profile varies during tool utilization. The large-area ball-joint-like connection always offers reliable bracing of the bit holder with respect to the tool bottom part for this varying force profile. As a result of the surface—relatively larger as compared with a flat area—offered by the spherical surface configuration, surface pressures can be reduced in the interest of a longer service life.

A compact design results in particular when provision is made that the base part is arranged in the attachment region onto the insertion projection.

It has been found that the radius of curvature of the support surface should be greater than or equal to 50 mm in order to correspond to the varying force profile. When the bit holder or tool bottom part is used for road milling machines, a radius of curvature in the range between 70 mm and 90 mm is suitable.

Roadway surfaces are milled off in this application, and different milling depths are required. Both the forces and the force directions vary with the different milling depths. It has been found that with the aforesaid radius of curvature range, particularly good service lives are obtained for these different milling depths.

According to a preferred variant of the invention, provision can be made that the longitudinal center axis of the insertion projection with respect to the center point around which the support surface is curved is in the range between 1 mm and 20 mm.

The result is that the surface parts that are arranged respectively on either side of the insertion projection and are responsible for the support effect can be varied as the user desires, and the spacing causes formation of a lever arm by which torques can be intercepted.

One conceivable variant of the invention is such that the base part comprises a front-side skirt, and the support surface at least locally forms the underside of the skirt. Provision can further be made that side parts are laterally adjacent to the base part, and that the support surface at least locally forms the underside of the side parts. The skirt and the side parts thus form an enlargement of the support surface and contribute to reducing the surface pressures. The skirt and the side parts furthermore have a protective function, since they can be designed so that they cover the tool bottom part and protect it from the aggressive attack of the detached material.

A particularly preferred variant of the invention is such that a circumferential groove is arranged in the transition region from the insertion projection to the support surface. This groove can be designed so that it serves as a preset breaking point. In the event of an impermissible overload of the bit holder, the latter can then break off in defined fashion so that the expensive tool bottom part does not suffer any damage. Additionally or alternatively, the circumferential groove can also form a sealing element receptacle into which a sealing element is inserted. The sealing element thus seals off the entrance region into the insertion receptacle of the tool bottom part into which the insertion projection of the tool holder is inserted. This prevents fine particles of detached material from penetrating into the region of the insertion receptacle of the tool bottom part, where they might cause jamming of the insertion projection in the insertion receptacle.

The conformation of the bit holder can be such that the insertion projection comprises two regions having a cross section of different sizes, the region having the larger cross section being associated closer to the support surface than the region having the smaller cross section. This makes possible easier installation and removal.

A bit holder according to the present invention can also be such that the bit receptacle comprises a discharge opening, extending transversely to the longitudinal center axis, that opens up the bit receptacle laterally toward the environment; and that the discharge opening is open toward the support surface. The discharge opening is preferably provided on the back side of the bit holder, opened radially outward and oppositely to the tool advance direction V. During tool utilization, detached material that penetrates into the region between the shank bit and the bit holder can be expelled through the discharge opening.

Particularly simple production becomes possible when the insertion projection has a circular cross section; and that the insertion projection or the base part comprises a twist preventer in the form of a projection or a receptacle. The circular insertion projection can be manufactured, for example lathe-turned, in simple fashion.

Provision can be made in particular in this context that a projection or a receptacle, in particular a flattened area, is arranged at the region of the larger cross section and/or of the smaller cross section of the insertion projection. The projection or receptacle can serve as a twist preventer. These components can moreover also be used for improved energy transfer and to minimize surface pressures.

The object of the invention is also achieved with a tool bottom part that is embodied to receive a bit holder. In particular, the tool bottom part can also comprise a counter-surface that receives the support surface of the bit holder and forms a counter-contour corresponding to the support surface. The counter-surface can be embodied, in particular, spherically and concavely. Particularly preferably, the counter-surface is penetrated by the entrance opening of an insertion receptacle. The insertion projection of the bit holder can be slid into the insertion receptacle. If provision is made that the insertion receptacle transitions into the counter-surface via a seal receptacle embodied as a cross sectional enlargement, the entrance region of the insertion receptacle can then be sealed in simple fashion, such that the combination of the support surface with the counter-surface forms a mechanical shield for the seal. Provision can also be made that the counter-surface is breached by a rearward opening. This opening creates access to the bit receptacle in the bit holder, so that a correspondingly configured drift tool can be inserted and the shank bit can be driven out therewith. This opening can transition, facing away from the counter-surface, into a recess of enlarged cross section. The recess offers generous access to the opening. This has advantages in particular when detached material has collected in the region of the opening. It can then easily be cleaned off in order to reestablish access to the shank bit.

If provision is made that the opening or the recess is arranged at least in part in the region of the entrance of a threaded receptacle that opens into the insertion receptacle, easier access to the threaded receptacle is then also offered, and a fastening screw for immobilizing the bit holder in the tool bottom part can easily be screwed in and removed.

The invention will be explained in further detail below with reference to an exemplifying embodiment depicted in the drawings, in which:

FIG. 1 is a side view of a bit holder changing system having a tool bottom part and a bit holder, FIG. 2 is a view from behind of the bit holder changing system according to FIG. 1, FIG. 3 shows the section marked III-III in FIG. 2, FIG. 4 is a perspective view from behind of the tool bottom part according to FIG. 1, FIG. 5 is a perspective view from the front of the tool bottom part according to FIG. 4, FIG. 6 is a side view of the bit holder according to FIG. 1, depicted in isolation, FIG. 7 is a perspective front view of a tool bottom part in a varied embodiment, and FIG. 8 is a perspective bottom view of a bit holder that is suitable for installation in the tool bottom part according to FIG. 7.

As is evident from these depictions, tool bottom part 20 possesses a lower seating surface 21 that is embodied concavely and serves to position tool bottom part 20 on the outer contour of a tubular milling drum. Tool bottom part 20 can be connected to the tubular milling drum, by means of welded joins, in the side regions adjacent to seating surface 21.

Figure 5:
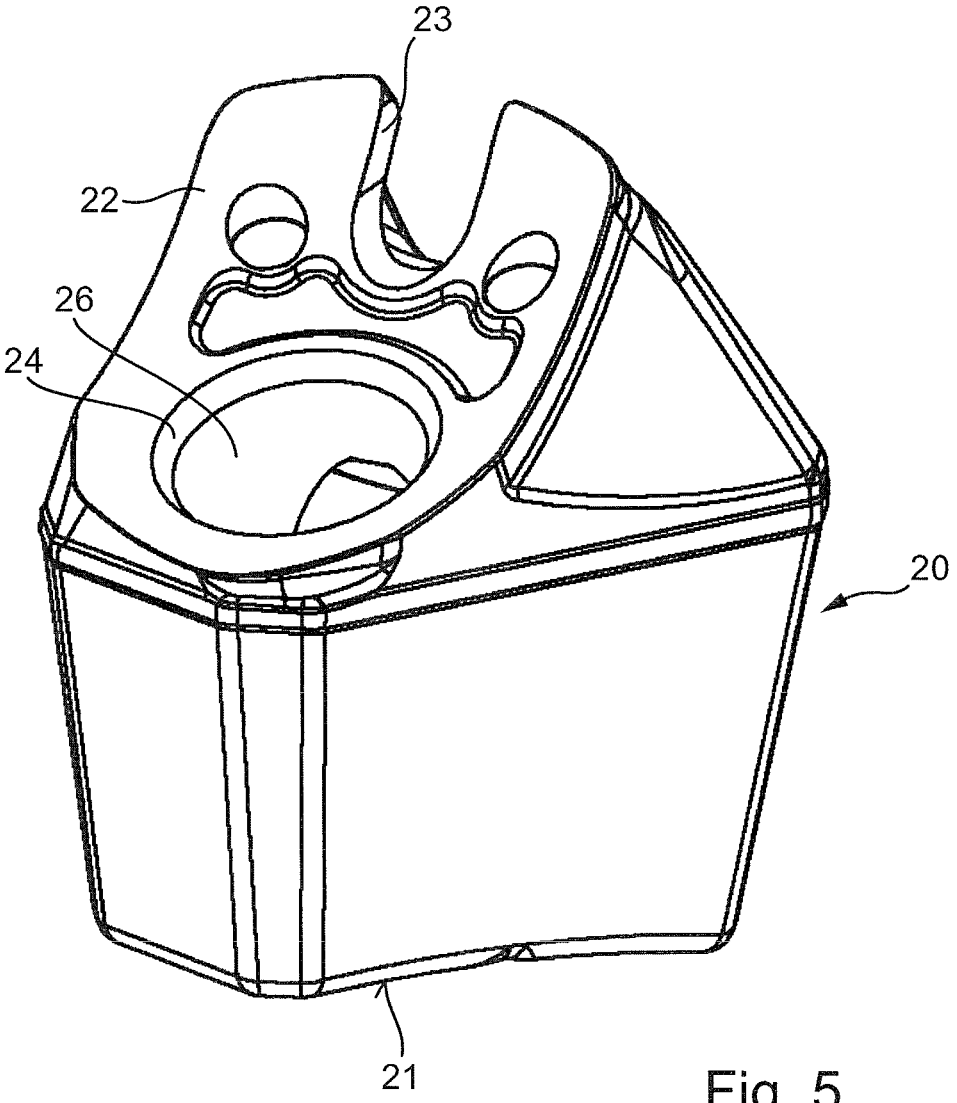

It is apparent from FIG. 5 that a cylindrical bore which serves as insertion receptacle 26 is introduced into tool bottom part 20. Insertion receptacle 26 transitions, via a bore enlargement that serves as seal receptacle 24, into a counter-surface 22. Counter-surface 22 is hollowed concavely into the surface of tool bottom part 20 and exhibits a spherical geometry. Counter-surface 22 is breached by an opening 23.

Figure 3:
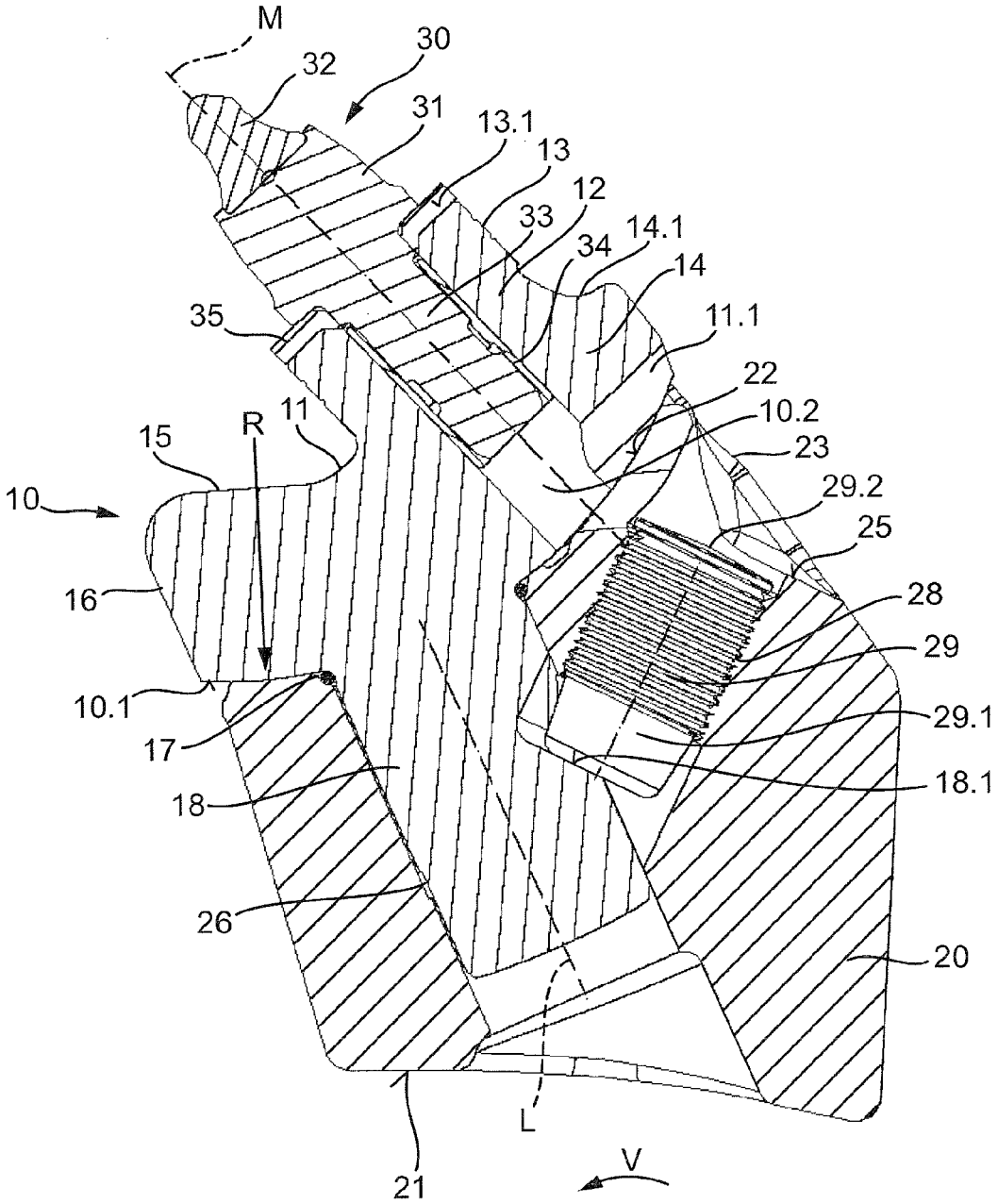
Figure 4:
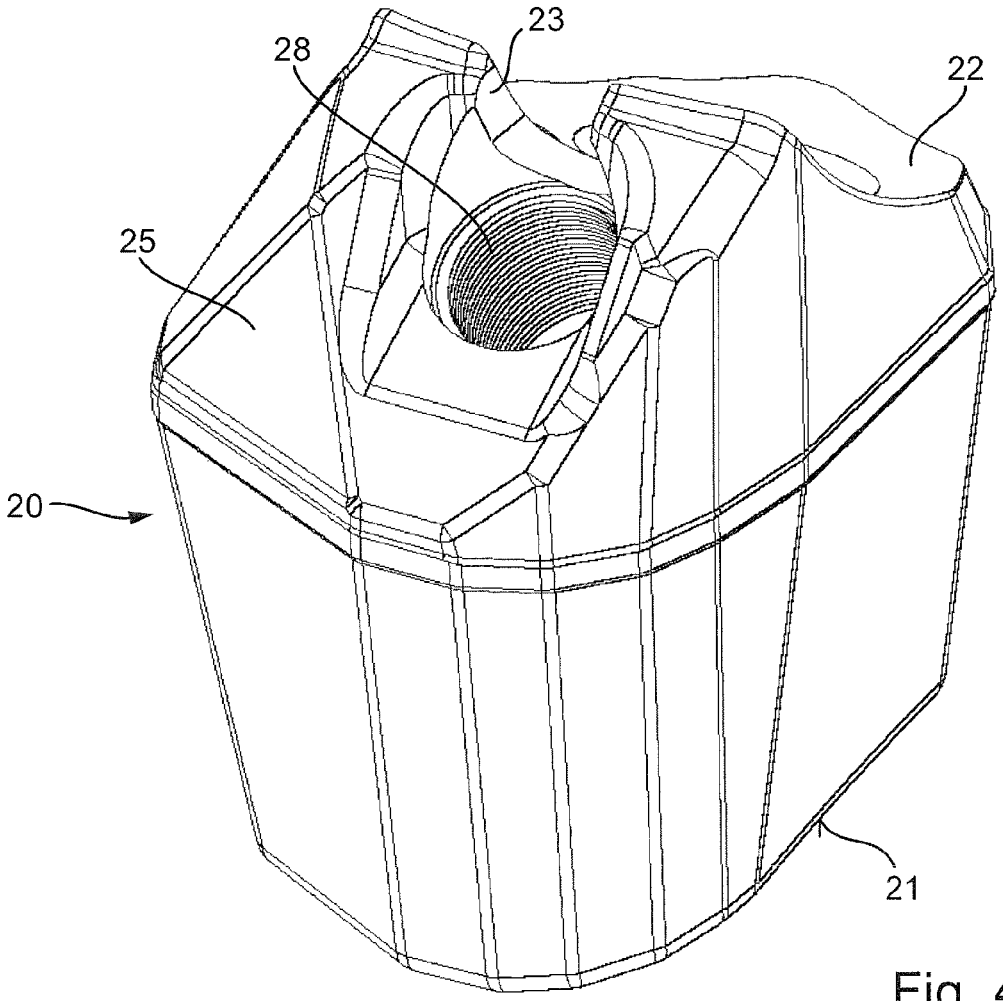
FIGS. 4 and 5 show the conformation of tool bottom part 20 in greater detail.

As is apparent from FIG. 4, opening 23 transitions into a recess 25. A threaded receptacle 28 is introduced into recess 25. Threaded receptacle 28 opens into insertion receptacle 26, as is apparent e.g. from FIG. 3.

The insertion projection 18 comprises two regions 18.3 and 18.4 having a cross-section of different sizes, the region 18.3 having the larger cross-section being associated closer to the support surface 10.1 than the region 18.4 having the smaller cross-section.

Figure 6:
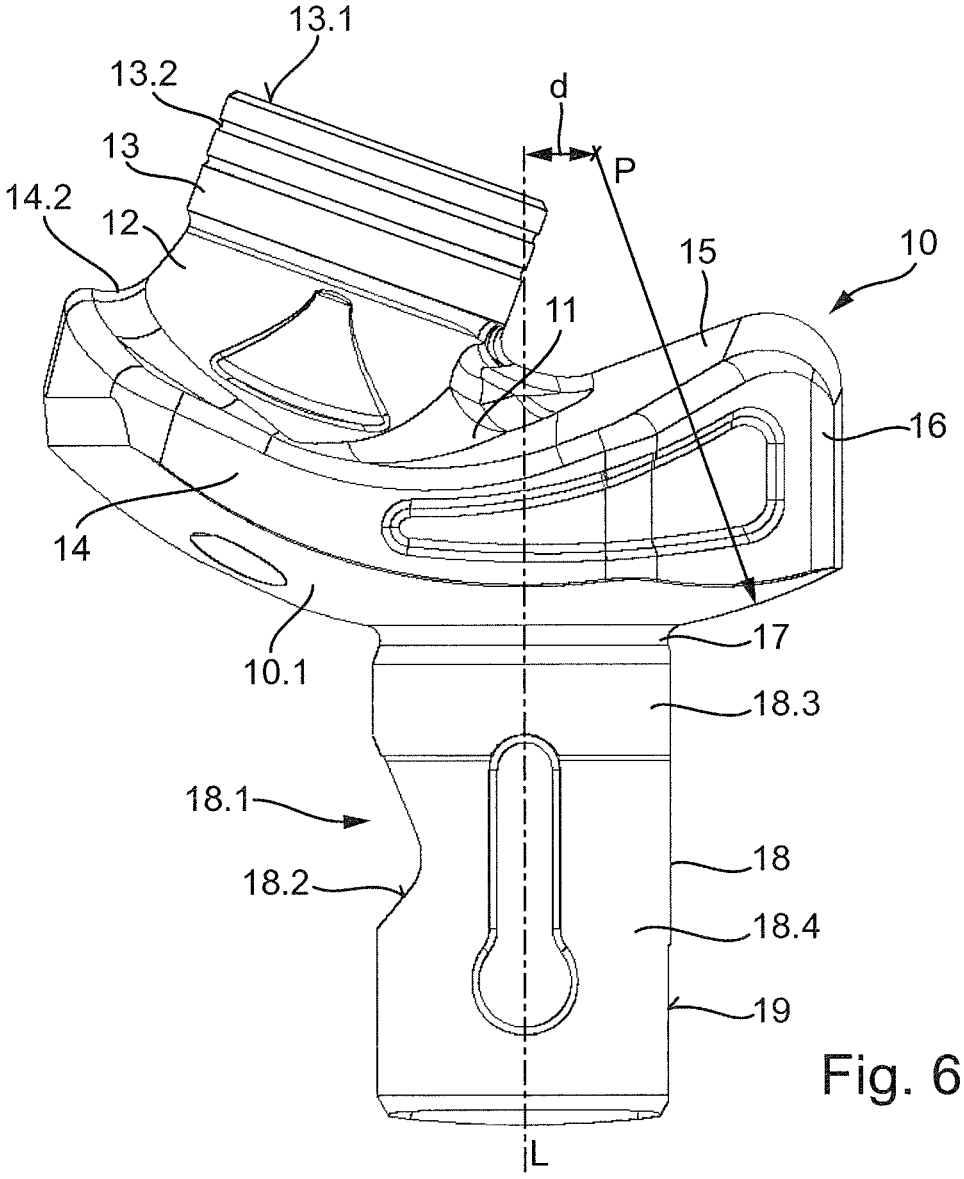

FIG. 6 depicts bit holder 10 in isolation. As shown in detail by this drawing, bit holder 10 comprises a base part 11 onto which a projection 12 is shaped. Projection 12 transitions into a cylindrical protrusion 13. This cylindrical protrusion 13 forms a flat abutment surface 13.1. Circumferential grooves that serve as wear markings 13.2 are recessed laterally into protrusion 13. These grooves extend at a parallel distance from abutment surface 13.1. Projection 12 transitions via fillet transitions 14.1 into side parts 14. Side parts 14 taper at the front side into a skirt 15. Skirt 15 is closed off at the front in tool advance direction V with a front segment 16. This front segment 16 is formed by flank surfaces set at an angle to one another, and an insertion projection 18 is shaped onto the underside of base part 11. Insertion projection 18 has substantially a cylindrical cross section. The dimensional layout of insertion projection 18 is selected so that it can be introduced into insertion receptacle 26 of tool bottom part 20. A circumferential groove 17 is recessed into the transition region between insertion projection 18 and base part 11. This groove 17 is directly adjacent to a downwardly directed support surface 10.1 of base part 11. Support surface 10.1 is spherically convexly curved. The dimensional layout is selected in this context so that support surface 10.1 can be placed in planar fashion onto counter-surface 22 of tool bottom part 20 when insertion projection 18 is inserted into insertion receptacle 26.

It is further evident from FIG. 6 that a step 18.1, which forms a pressure surface 18.2, is cut out of insertion projection 18. Insertion projection 18 is provided on the front side with a milled surface that forms a twist preventer 19.

FIG. 3 depicts the bit holder changing system in its assembled state. As this drawing illustrates, bit holder 10 can be slid with its insertion projection 18 into insertion receptacle 26. The insertion motion of bit holder 10 is limited by support surface 10.1, which comes to rest on counter-surface 22. A circumferential seal in the form of an O-ring is pulled onto insertion projection 18 and comes to rest in groove 17. With bit holder 10 in the assembled state, this seal is inserted in seal receptacle 24, and the entrance region into insertion receptacle 26 is sealed around insertion projection 18. A compression screw 29 is used to immobilize bit holder 10 in tool bottom part 20. This screw is threaded with its external thread into thread 28 of tool bottom part 20. Compression screw 29 comprises a compression piece 29.1 that sits with a flat end surface onto pressure surface 18.2 of step 18.1. Upon tightening of compression screw 29, a draw-in force is introduced into insertion projection 18. The result of this draw-in force is that support surface 10.1 is pressed with a preload against counter-surface 22. Once compression screw 29 has been tightened with a predetermined torque, the tool receptacle of compression screw 29 (hex socket) can be covered by means of a cover washer 29.2 so that it cannot become soiled.

Figure 1:
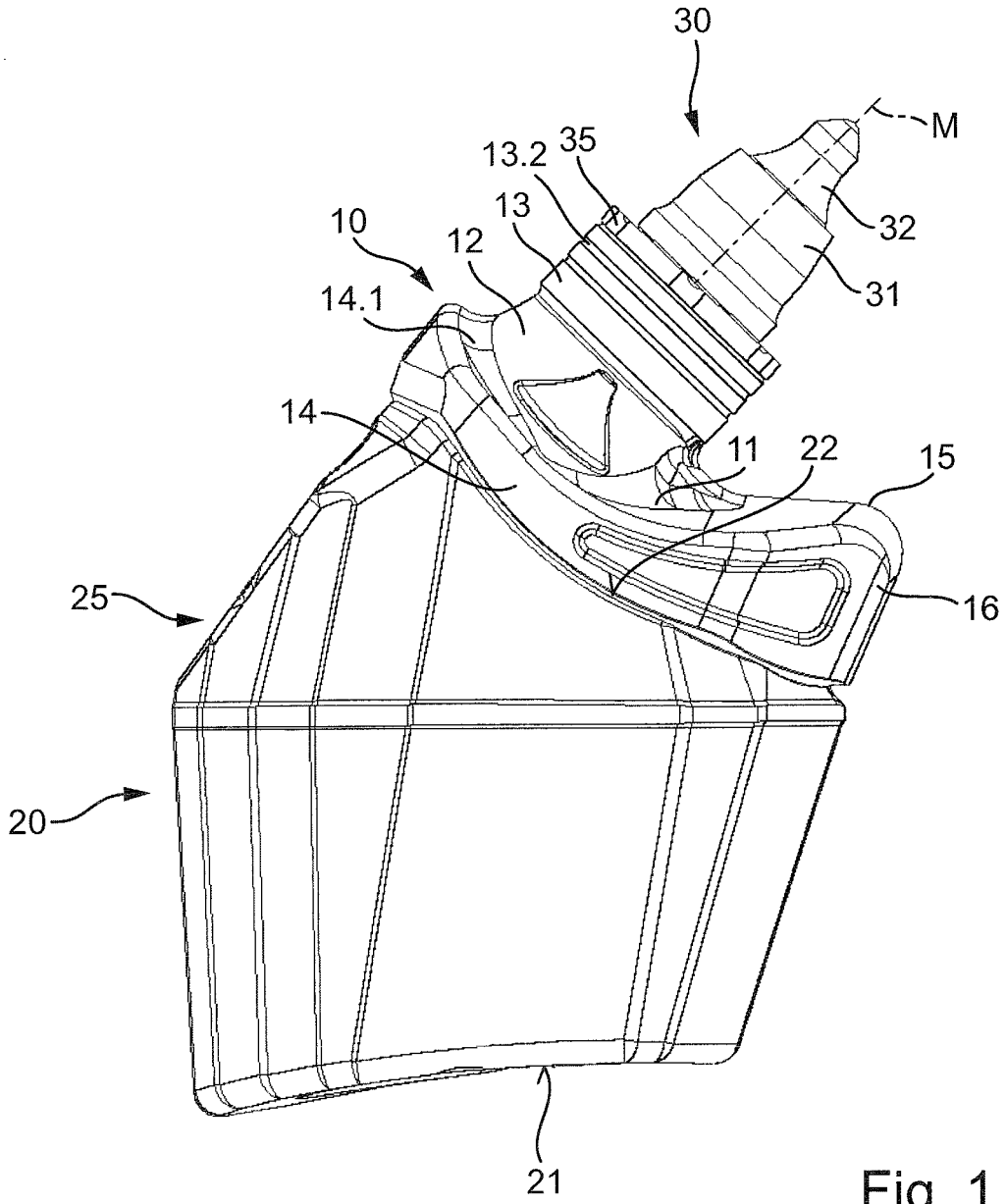
FIG. 1 shows a tool changing system having a tool bottom part 20 and a bit holder 10.
Figure 2:
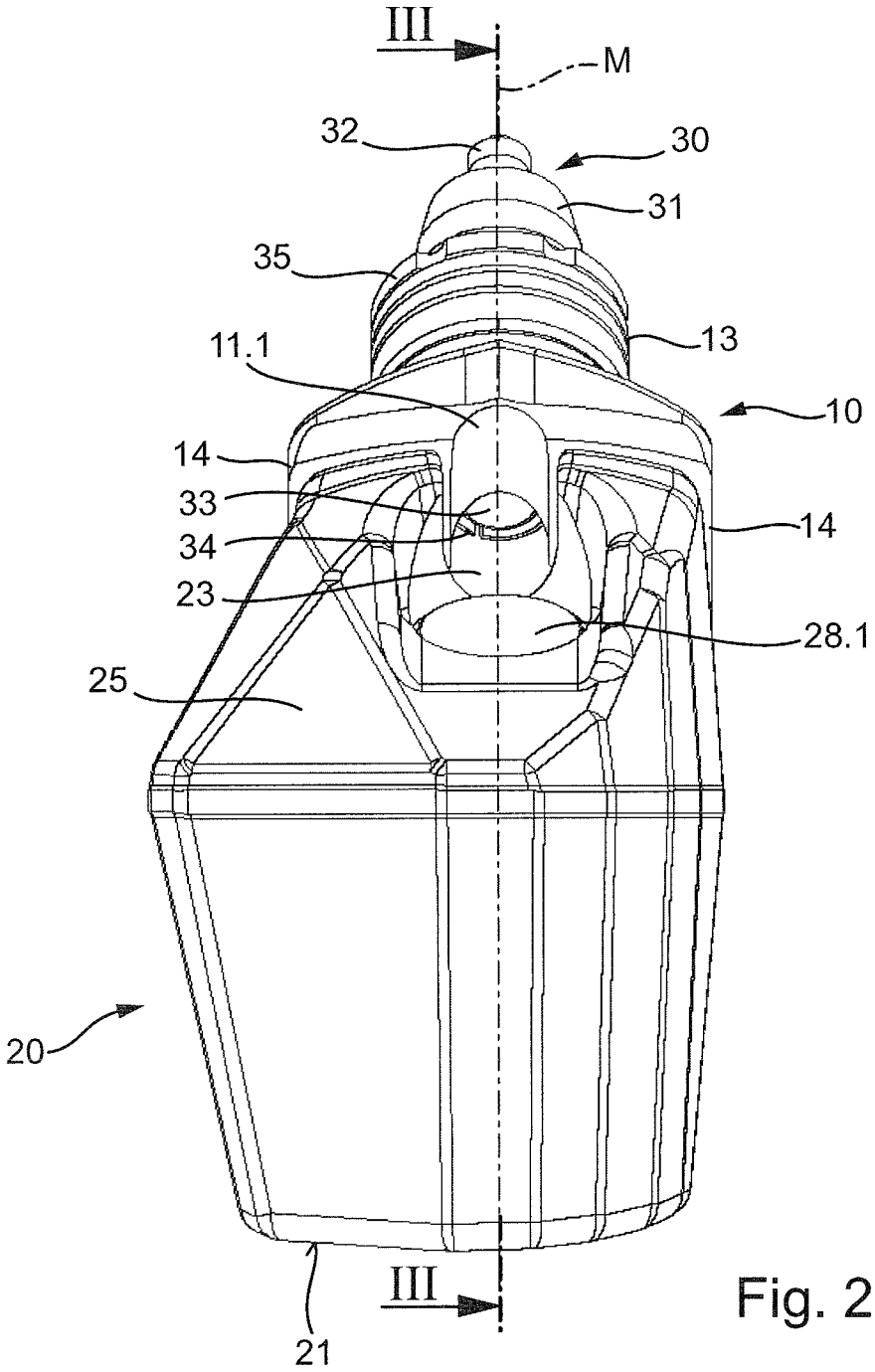

In the assembled state, as is apparent from FIG. 2, openings 23 of tool bottom part 20 are in physical communication with a discharge opening 11.1 of bit holder 10. The conformation of discharge opening 11.1 may be gathered in more detail from FIG. 3. As is apparent from this depiction, discharge opening 11.1 offers access, oppositely to tool advance direction V, to a bit receptacle 10.2 that is introduced in the form of a cylindrical bore into bit holder 10. It is further apparent from FIG. 3 that longitudinal center axis M of bit receptacle 10.2 is arranged according to the present invention in such a way that it intersects support surface 10.1 and thus counter-surface 22. This intersection point is furthermore selected so that support surface 10.1 is pulled at least locally over bit receptacle 10.2 in a radial direction perpendicular to tool advance direction V, i.e. upward in the drawing plane as shown in FIG. 3. This results in a rear-side support region by way of which even abrupt tool stresses can reliably be dissipated with no risk that projection 12 will break away. A shank bit 30, in the present case a round shank bit, can be inserted into bit receptacle 10.2. Shank bit 30 comprises a bit head 31 having a soldered-in bit tip 32 made of hard material. A shank 33 is shaped onto bit head 31. Shank 33 carries a clamping sleeve 34. This clamping sleeve 34 keeps shank bit 30 locked in the bit receptacle in such a way that shank 33 is held freely rotatably in a circumferential direction, but in lossproof fashion in the direction of longitudinal center axis M. Bit head 31 is braced against abutment surface 13.1 with interposition of a wear protection washer 35. Wear protection washer 35 thus protects projection 12 from the rotating wear of bit head 31.

Twist preventer 19 can be used to prevent the cylindrical insertion projection 18 from being twisted in insertion receptacle 26 of tool bottom part 20. Said preventer can, for example, abut against a shaped surface provided therefor in insertion receptacle 26 and can thus retain bit holder 10 in twistproof fashion.

In the present case, twist preventer 19 is made up of two flattened areas, abutting against one another, that are provided respectively on insertion projection 18 and in insertion receptacle 26.

Figure 7:
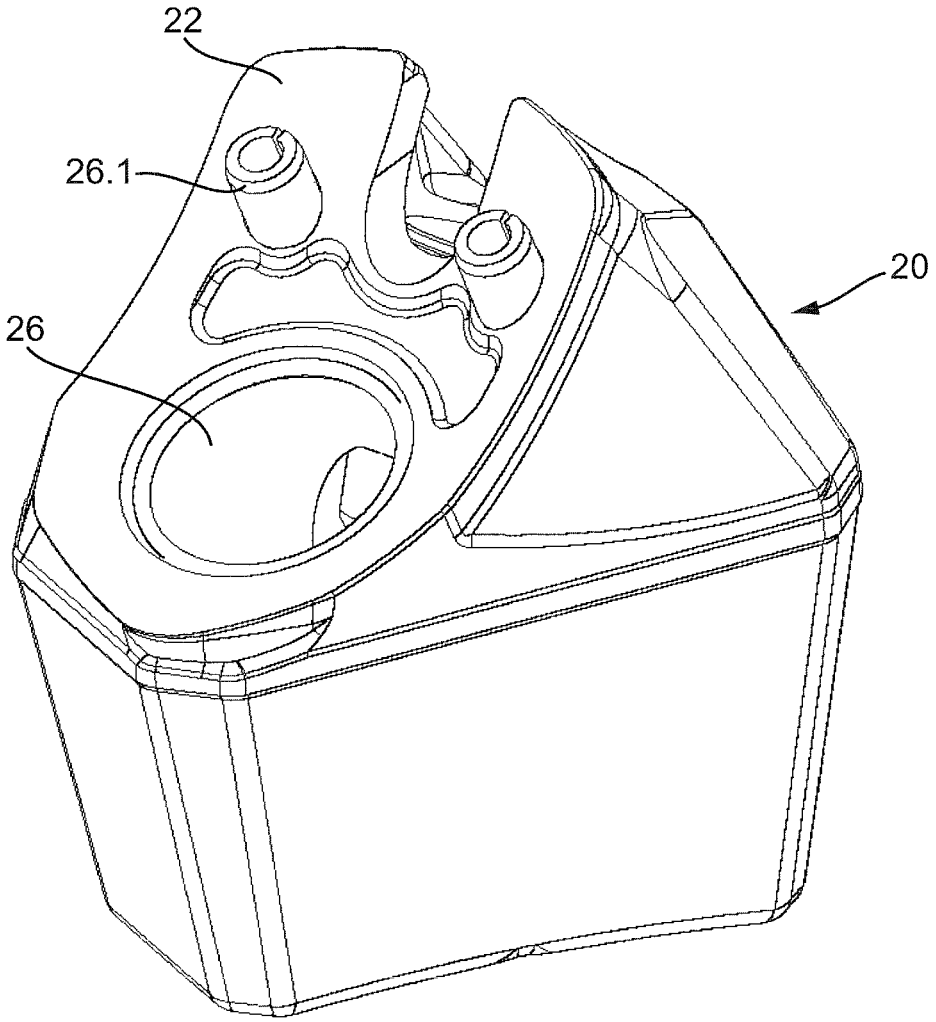
Figure 8:
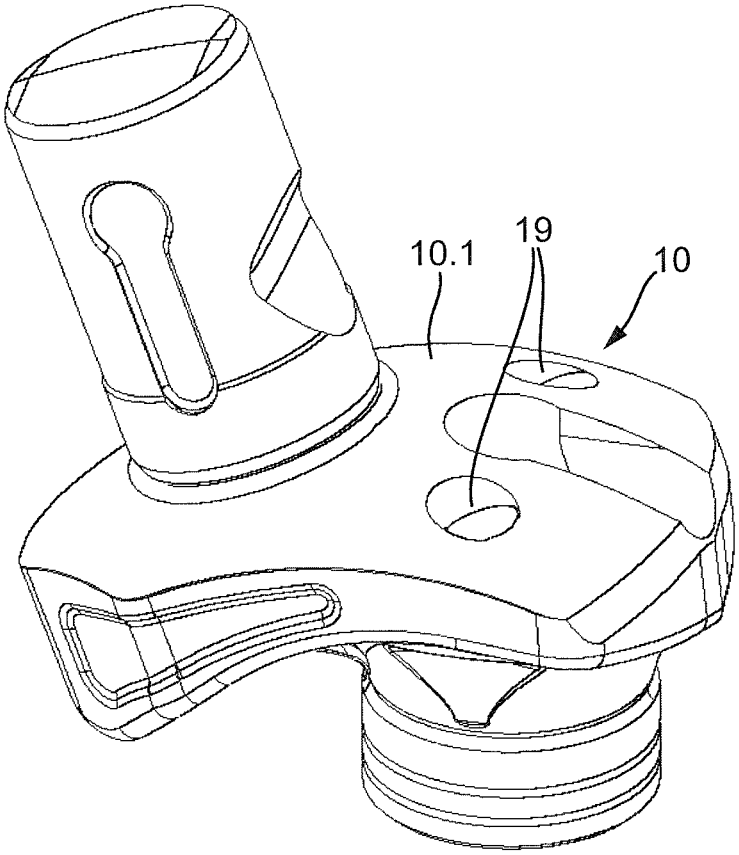

An alternative variant configuration of a twist preventer 19 is shown in FIGS. 7 and 8. As is apparent from this depiction, tool bottom part 20 corresponds substantially to the conformation of tool bottom part 20 according to FIGS. 4 and 5. Bit holder 10 depicted in FIG. 8 corresponds substantially to quick-change bit holder 10 shown in FIGS. 1 to 3 and 6. Only the differences therefore need to be discussed below. Tool bottom part 20 accordingly comprises in the region of counter-surface 22 an elevation that forms a shaped part 26.1. In the present case what can be used as shaped part 26.1 is a stud or a sleeve, in particular a heavy-duty dowel pin or a taper pin, that is pressed into a bore that is introduced into counter-surface 22. In the assembled state, shaped part 26.1 fits into a bore that is introduced into support surface 10.1 of bit holder 10 and serves as twist preventer 19. This arrangement of twist preventer 19 in the region of support surface 10.1 is particularly advantageous because it is protected there from the aggressive attack of the detached material.

Bit holders 10 depicted in the drawings are designed in a manner particularly favorable for manufacture. The contour that forms support surface 10.1 and the cylindrical external geometry of insertion projection 18 can thus be lathe-turned in one clamping, so that time-consuming reclamping operations are not necessary.

In the exemplifying embodiment, support surface 10.1 is provided on base part 11 and connects the latter integrally to insertion projection 18.

Alternatively in the context of the invention, support surface 10.1 can also be provided on a base part 11 of bit holder 10 which is arranged separately from insertion projection 18 and/or from projection 12.

The invention claimed is:

1. A tool apparatus, comprising:

a base part having a convexly curved support surface having a spherical surface contour;

an insertion projection extending from the base part; and a bit longitudinal center axis defined in the base part, the bit longitudinal center axis intersecting the support surface.

2. The apparatus of claim 1, wherein:

the insertion projection is attached to the base part in an attachment region.

3. The apparatus of claim 2, wherein:

the attachment region has a circumferential groove defined therein.

4. The apparatus of claim 3, further comprising:

a sealing element received in the circumferential groove.

5. The apparatus of claim 1, wherein:

the spherical surface contour of the support surface has a radius of curvature of greater than or equal to 50 mm.

6. The apparatus of claim 5, wherein:

the radius of curvature is in a range of from 70 mm to 90 mm.

7. The apparatus of claim 1, wherein:

the insertion projection has an insertion projection longitudinal center axis;

the spherical surface contour is curved about a center point; and an offset of the insertion projection longitudinal center axis with respect to the center point of the spherical surface contour is in a range of from 1 mm to 20 mm.

8. The apparatus of claim 1, wherein:

the base part includes a front-side skirt, and the support surface at least locally forms an underside of the skirt.

9. The apparatus of claim 1, further comprising:

side parts laterally adjacent to the base part; and wherein the support surface at least locally forms undersides of the side parts.

10. The apparatus of claim 1, wherein:

the insertion projection includes a larger cross-section region and a smaller cross-section region, the larger cross-section region being located closer to the support surface than is the smaller cross-section region.

11. The apparatus of claim 1, wherein:

the bit longitudinal center axis is defined by a bit receptacle, and the bit receptacle includes a discharge opening extending transversely to the bit longitudinal central axis and opening the bit receptacle laterally to an environment, the discharge opening also being open toward the support surface.

12. The apparatus of claim 1, wherein:

the insertion projection has a circular cross-section; and at least one of the insertion projection and the base part comprises a twist preventer in the form of a projection or a receptacle.

13. The apparatus of claim 1, wherein:

the insertion projection has a circular cross-section; and a flattened area is formed on the insertion projection to prevent twisting of the apparatus.

14. The apparatus bit holder of claim 13, wherein:

the insertion projection has a larger cross-section portion and a smaller cross-section portion; and the flattened area is formed on at least one of the larger cross-section portion and the smaller cross-section portion.

15. The apparatus of claim 1, in a combination further comprising:

a bottom part having a concave counter-surface configured to support the convexly curved support surface of the tool apparatus, the bottom part having an insertion receptacle receiving the insertion projection of the tool apparatus, the insertion receptacle intersecting the counter-surface.

16. The combination of claim 15, further comprising:

a seal disposed around the insertion projection and sealing between the tool apparatus and the bottom part around an entrance opening of the insertion receptacle.

17. The combination of claim 15, wherein:

the counter-surface is breached by a rearward opening.

18. The combination of claim 17, wherein:

the counter-surface transitions, facing away from the counter-surface, into a recess of enlarged cross-section.

19. The combination of claim 17, wherein:

the bottom part has a threaded receptacle defined therein, the threaded receptacle opening into the insertion receptacle, the threaded receptacle having an entrance; and the rearward opening is communicated with the entrance of the threaded receptacle.

20. A tool bottom part for receiving a tool apparatus, the bottom part comprising:

a spherically concave counter-surface for supporting the tool apparatus;

an insertion receptacle having an entrance opening defined in the counter-surface; and a threaded receptacle extending transversely to the insertion receptacle and opening into the insertion receptacle.

21. The tool bottom part of claim 20, wherein:

a cross-section of the insertion receptacle is enlarged adjacent the entrance opening to define a seal receptacle.

22. The tool bottom part of claim 20, wherein:

the counter-surface is breached by a rearward opening.

23. The tool bottom part of claim 22, wherein:

the counter-surface transitions, facing away from the counter-surface, into a recess of enlarged cross-section.

24. The tool bottom part of claim 22, wherein:

the threaded receptacle has an entrance; and the rearward opening is communicated with the entrance of the threaded receptacle.

* * * * *